US008818214B2

(12) United States Patent
Shimura

(10) Patent No.: US 8,818,214 B2
(45) Date of Patent: Aug. 26, 2014

(54) HEATING APPARATUS AND IMAGE FORMING APPARATUS

(75) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 13/093,218

(22) Filed: Apr. 25, 2011

(65) Prior Publication Data

US 2011/0280596 A1 Nov. 17, 2011

(30) Foreign Application Priority Data

May 12, 2010 (JP) ..... 2010-110521
Apr. 13, 2011 (JP) ..... 2011-089377

(51) Int. Cl.
*G03G 15/20* (2006.01)
*G03G 15/00* (2006.01)

(52) U.S. Cl.
CPC ..... *G03G 15/2053* (2013.01); *G03G 15/55* (2013.01); *G03G 15/5012* (2013.01); *G03G 15/80* (2013.01)
USPC ..... 399/33; 399/69; 399/88

(58) Field of Classification Search
CPC ..... G03G 15/2053; G03G 15/5012; G03G 15/55; G03G 15/80
USPC ..... 399/33, 69, 88; 219/485, 507
See application file for complete search history.

(56) References Cited

U.S. PATENT DOCUMENTS

| | | | | |
|---|---|---|---|---|
| 3,794,950 | A * | 2/1974 | Kilner | 338/23 |
| 5,229,577 | A | 7/1993 | Matsuura et al. | |
| 7,630,662 | B2 | 12/2009 | Namiki et al. | |
| 8,606,136 | B2 * | 12/2013 | Shimura et al. | 399/67 |
| 2004/0146311 | A1 * | 7/2004 | Kawazu et al. | 399/45 |
| 2007/0280720 | A1 * | 12/2007 | Kimura | 399/88 |
| 2010/0310267 | A1 | 12/2010 | Shimura et al. | |
| 2012/0000897 | A1 * | 1/2012 | Shimura | 219/216 |

FOREIGN PATENT DOCUMENTS

| | | |
|---|---|---|
| JP | 07-199702 | 8/1995 |
| JP | 3919670 | 2/2007 |
| JP | 2007-212503 | 8/2007 |

* cited by examiner

*Primary Examiner* — Benjamin Schmitt
(74) *Attorney, Agent, or Firm* — Fitzpatrick, Cella, Harper & Scinto

(57) ABSTRACT

The heating apparatus includes a first detection part which detects whether or not the power supplied to the heat generation member is in an overpower state by detecting a positive phase of a half wave in an alternating voltage of a commercial power supply applied to the first or the second current path of the heat generation member, a second detection part which detects whether the power supplied to the heat generation member is in an overpower state or not by detecting a negative phase of a half wave in an alternating voltage the commercial power supply applied to the first current path or the second current path of the heat generation member, and a control part which controls itself to stop supplying power from the commercial power supply to the heat generation member in a case where an overpower state is detected by the first or second detection part.

10 Claims, 16 Drawing Sheets

| | TRIAC TR1 FULL WAVE SHORT FAILURE | TRIAC TR1 POSITIVE SIDE OF HALF WAVE SHORT FAILURE | TRIAC TR1 NVEGATIVE SIDE OF HALF WAVE SHORT FAILURE |
|---|---|---|---|
| VOLTAGE WAVEFORM |   |   |   |
| VOLTAGE EFFECTIVE VALUE | 200V | 141V | 141V |
| CURRENT EFFECTIVE VALUE | 10A | 7A | 7A |
| POWER VALUE | 4000W | 2000W | 2000W |

HEATING APPARATUS AND IMAGE FORMING APPARATUS

BACKGROUND OF THE INVENTION

1. Field of the Invention

The present invention relates to a heating apparatus for use in an image forming apparatus such as a facsimile machine and a laser beam printer.

2. Description of the Related Art

The image forming apparatus includes a heating apparatus used to heat and fix a toner image transferred to a recording material. The heating apparatus includes a nip portion made of a heating member maintained at a predetermined temperature and a pressure roller pressure-contacted with the heating member. The nip portion uses a process of heating a recording material while pinching and conveying the recording material as a heated material. Particularly, as the heating member of the heating apparatus using a film heating process, there is generally used a heater with a resistance heat generation member formed on a substrate such as a ceramic. When a heater with the same resistance value is used in the heating apparatus using a resistance heat generation member in regions with a commercial power supply of a 100 V system and a 200 V system, the maximum power capable of being supplied to the heater with a commercial power supply of 200 V system is four times that of a 100 V system. This is because the power supplied to the heater is proportional to the square of the voltage. Note that, for example, the commercial power supply of a 100 V system is in a range of a commercial power supply of 100 V to 127 V; and the commercial power supply of a 200 V system is in a range of a commercial power supply of 200 V to 240 V. The larger the maximum power suppliable to the heater, the larger the effects of a harmonic current, flicker, and the like generated by a heater power control, such as a phase control and a wavenumber control. In addition, the power generated when the heating apparatus suffers a runaway phenomenon increases to four times, and thus a more responsive safety circuit is required. Therefore, there is often used a heating apparatus using a heater having different resistance values in a region with a commercial power supply of a 100 V system and in a region with a commercial power supply of a 200 V system. In contrast to this, there has been proposed a unit for implementing a heating apparatus (hereinafter referred to as a universal type of heating apparatus) that can be shared between in a region with a commercial power supply of a 100 V system and in a region with a commercial power supply of a 200 V system. As the unit for implementing the universal-type heating apparatus, for example, there has been proposed a method of switching the heater resistance value using a switch unit such as a relay. For example, Japanese Patent Application Laid-Open No. H07-199702 and U.S. Pat. No. 5,229,577 disclose a heating apparatus having a configuration of a first current path and a second current path extending in a longitudinal direction of the heater (a direction orthogonal to the conveyance direction of a recording material). There is proposed a method of switching the heater resistance value by switching between a first operating state of conducting by serially connecting the first current path and the second current path and a second operating state of conducting by a parallel connection of the first current path and the second current path.

The methods of switching between the serial connection and the parallel connection of the two current paths will be described in detail. Japanese Patent Application Laid-Open No. H07-199702 discloses a method of using a make contact (always-open-contact) relay or a break contact (always-close-contact) relay and a BBM contact (break-before-make contact) relay. Note that instead of the BBM contact relay, two make contact relays or a make contact relay and a break contact relay may be used. U.S. Pat. No. 5,229,577 proposes a method of using two BBM contact relays. According to the above methods, a determination is made as to whether the supply voltage is a 100 V system or a 200 V system; based on the determination, the heater current path is switched between the serial connection and the parallel connection; and thus the heater resistance value can be switched without changing the heating region of the heater.

However, in the aforementioned method (configuration) of switching between the serial connection and the parallel connection, a failure in a supply-voltage detection part or a resistance-value switching relay may cause the heater to enter an overpower-suppliable state. For example, in a state in which a supply voltage of a 200 V system is supplied and in a state in which the heater resistance value is reduced (second operating state), a power four times as large as normal can be supplied to the heater. Therefore, a conventional safety circuit using a temperature detection element such as a thermistor, a temperature fuse, and a thermo switch may suffer from an insufficient response speed. Thus, a heating apparatus capable of switching the resistance value needs to have a unit for detecting a failure state in which large power may be supplied to the heater or a unit for suppressing the power supplied to the heater regardless of the operating state of the heater.

SUMMARY OF THE INVENTION

In view of such circumstances, the present invention has been made, and an object of the present invention is to provide a heating apparatus capable of switching a resistance value, detecting a failure state of the heating apparatus in a simple configuration, and further increasing the safety of the heating apparatus.

Another purpose of the present invention is to provide a heating apparatus for supplying power to heat generation member having first and second current paths connected in a serial connection or a parallel condition so that a resistance value of the heat generation member is switchable, the heating apparatus including a first detection part which detects whether or not the power supplied to the heat generation member is in an overpower state by detecting a positive phase of a half wave in an alternating voltage of a commercial power supply applied to the first current path or the second current path of the heat generation member; a second detection part which detects whether the power supplied to the heat generation member is in an overpower state or not by detecting a negative phase of a half wave in an alternating voltage the commercial power supply applied to the first current path or the second current path of the heat generation member, and a control part which stops supplying power from the commercial power supply to the heat generation member in a case where an overpower state is detected by the first detection part or the second detection part.

A further purpose of the present invention is to provide an image forming apparatus including: an image forming part for forming an image on a recording material; and a heating part for fixing the image on the recording material by heating the recording material on which the image is formed by a heat generation member, the image forming apparatus supplying power to the heat generation member and capable of switching a resistance value of the heat generation member by serially connecting or connecting in parallel a first current path and a second current path of the heat generation member;

a first detection part which detects whether or not the power supplied to the heat generation member is in an overpower state by detecting a positive phase of a half wave in an alternating voltage of a commercial power supply applied to the first current path or the second current path of the heat generation member; a second detection part which detects whether the power supplied to the heat generation member is in an overpower state or not by detecting a negative phase of a half wave in an alternating voltage the commercial power supply applied to the first current path or the second current path of the heat generation member; and a control part which stops supplying power from the commercial power supply to the heat generation member in a case where an overpower state is detected by the first detection part or the second detection part.

A still further purpose of the present invention will become apparent from the following description of exemplary embodiments with reference to the accompanied drawings.

DESCRIPTION OF THE EMBODIMENTS

Preferred embodiments of the present invention will now be described in detail in accordance with the accompanying drawings.

Hereinafter, the configuration and the operation of the present invention will be described. It should be noted that the following embodiments are just examples and should not be construed to limit the technical scope of the present invention to only those embodiments.

Configuration of Fixing Apparatus

Figure 1:
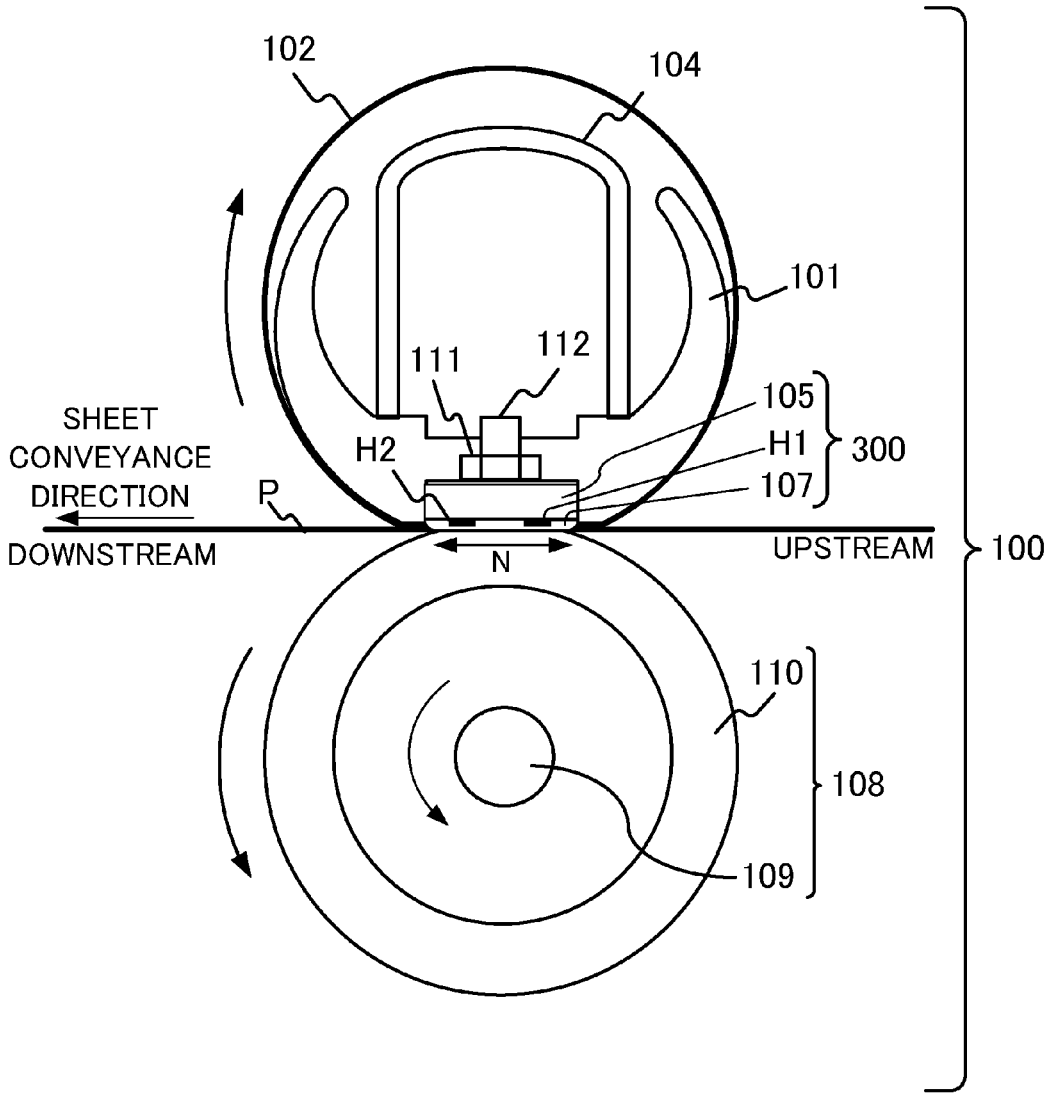
FIG. 1 illustrates a cross section of a fixing apparatus according to first to fourth embodiments.

FIG. 1 is a cross sectional view of a fixing apparatus 100 as an example of a heating apparatus. The fixing apparatus 100 includes a cylindrical film (endless belt) 102; a heater 300 (heat generation member) contacting an inner surface of the film 102; and a pressure roller (nip part forming member) 108 forming a fixing nip part N together with the heater 300 sandwiching the film 102 therebetween. The material of a base layer of the film 102 is a heat-resistant resin such as a polyimide or a metal such as stainless. The pressure roller 108 includes a core bar 109 made of iron or aluminum; and an elastic layer 110 made of silicone rubber or the like. The heater 300 is held by a holding member 101 made of a heat-resistant resin. The holding member 101 also functions as a guide for guiding the rotation of the film 102. The pressure roller 108 is powered by an unillustrated motor and is rotated in a direction indicated by the arrow. The film 102 is rotated following the rotation of the pressure roller 108. The heater 300 includes a ceramic heater substrate 105; a current path H1 (first column) which is a first current path formed on the heater substrate 105 using a heat resistance member; and a current path H2 (second column) which is a second current path formed thereon. The heater 300 further includes an insulating surface protection layer 107 (e.g., glass in the present embodiment) covering the current paths H1 and H2. A temperature detection element 111 such as a thermistor abuts against a sheet-passing region which is located on a rear side of the heater substrate 105 and through which a sheet of a usable minimum size (e.g., envelope DL: 110 mm wide in the present embodiment) set in a printer can pass. Note that the recording-material width refers to the length of a recording material in a direction orthogonal to the conveyance direction of the recording material. The CPU 203 described later (see FIG. 2A) controls power to be supplied from a commercial AC power supply to the current paths H1 and H2 according to the temperature detected by the temperature detection element 111. The recording material (sheet) P carrying an unfixed toner image is conveyed from upstream to downstream in a sheet-conveyance direction (direction indicated by the arrow in the figure) and is heated and fixed while being pinched and conveyed through a fixing nip part N. Then, the unfixed toner image on the recording material is fixed thereto. A safety element 112, such as a thermo switch, which is activated when the temperature of the heater 300 abnormally increases and then turns off a power supply line to a heat line, also abuts against the rear side of the heater substrate 105. The safety element 112 abuts against the sheet-passing region for a minimum size sheet in the same manner as the temperature detection element 111. A metallic stay 104 applies pressure on the holding member 101 by an unillustrated spring.

Hereinafter, the configuration and the operation of the first embodiment will be described.

Heater Control Circuit

Figure 2A:
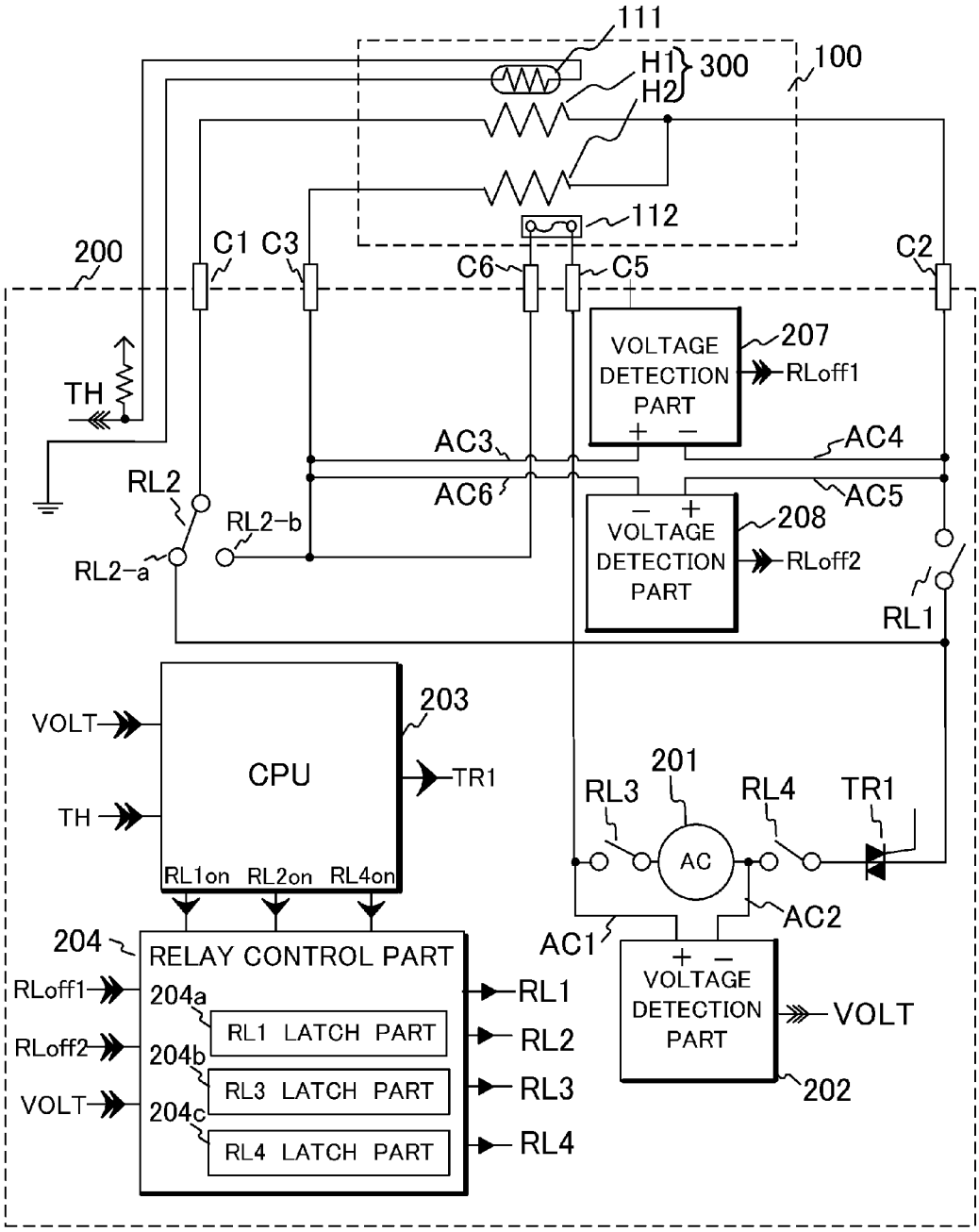
FIGS. 2A and 2B illustrate a configuration of a fixing apparatus, a control circuit and a voltage detection part according to the first embodiment.
Figure 2B:
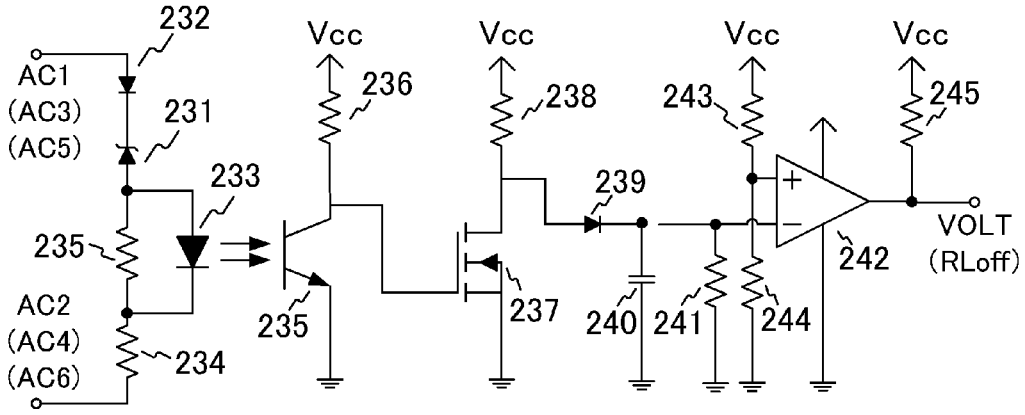

FIGS. 2A and 2B illustrate a control circuit 200 of the heater 300 according to the first embodiment. More specifically, FIG. 2A is a circuit block diagram for illustrating the control circuit 200; and FIG. 2B is a circuit diagram for illustrating a voltage detection part 202, a voltage detection part 207 and a voltage detection part 208. Connectors C1, C2, C3, C5 and C6 connect the control circuit 200 and the fixing apparatus 100. Power control from a commercial AC power supply 201 to the heater 300 is performed by turning on and off a bidirectional thyristor (hereinafter referred to as a triac) TR1. The triac TR1 operates in response to a signal from the CPU 203 for driving the heater 300. The temperature detected by the temperature detection element 111 is detected as a voltage divided by a pull-up resistor and input to the CPU 203 as a TH signal. The internal processing of the CPU 203 is as follows. Based on the temperature detected by the temperature detection element 111 and the temperature set by the heater 300, power to be supplied is calculated, for example, by a PI control and is converted to a control level of a phase angle (phase control) and a wavenumber (wavenumber control) to control the triac TR1. A triac drive circuit or a zero-crossing detection circuit disclosed in Japanese Patent Application Laid-Open No. 2007-212503 may be used as a circuit for operating an unillustrated triac TR1.

Voltage Detection Part

Now, the voltage detection part 202 and the relay control part 204 will be described. Note that a detailed description of the relay-control sequence will be given by referring to FIGS. 5A and 5B. FIG. 2A illustrates a connection state of a contact in a power-off state of relays RL1, RL2, RL3 and RL4, which are switches. When the fixing apparatus 100 enters a standby state, the relay RL3 enters an on state at the same time, and the voltage detection part 202 detects a voltage of the commercial AC power supply 201. The voltage detection part 202, which is a voltage detection part which detects a commercial-power-supply voltage, determines whether the supply-voltage range indicates that the commercial AC power supply is a 100 V system (e.g., a range from 100 V to 127 V) or a 200 V system (e.g., a range from 200 V to 240 V). The voltage detection part 202 outputs a voltage-detection result to the CPU 203 and the relay control part 204 as a VOLT signal. If the supply-voltage range indicates that the commercial AC power supply 201 is the 200 V system, the VOLT signal output by the voltage detection part 202 is in a low state. The detailed description of the voltage detection part 202 will be given by referring to FIG. 2B. When the voltage detection part 202 detects the 200 V system, the relay control part 204 operates an RL1 latch part 204*a* to hold the relay RL1 in an off state as is. When the RL1 latch part 204*a* operates, the relay RL1 maintains the off state even though an RL1 on signal output from the CPU 203 to the relay control part 204 is a high state. Instead of the aforementioned latch circuit, the operation of the relay control part 204 may be implemented by a hardware circuit which holds the relay RL1 in an off state while the VOLT signal detects a low state. Based on the voltage-detection result by the voltage detection part 202, the CPU 203 holds the relay RL2 in an off state as is (connecting to a left contact RL2-*a*). Here, the off state of the relay RL2 refers to a state of connecting to a contact RL2-*a*, while the on state thereof refers to a state of connecting to a contact RL2-*b*. Further, when the CPU 203 places the RL4 on signal in a high state and operates the RL4 latch part 204*c* of the relay control part 204 to place the relay RL4 in an on state (connection state), the fixing apparatus 100 is in a power-suppliable state. Since the fixing apparatus 100 is in a power-suppliable state and the current path H1 is serially connected to the current path H2, the heater 300 enters a state with a high resistance value.

When the voltage detection part 202 detects the 100 V system, the CPU 203 places the RL1 on signal in a high state and the relay control part 204 operates the RL1 latch part 204*a* to place the relay RL1 in an on state. Based on the VOLT signal output by the voltage detection part 202, the CPU 203 places the RL2 on signal in a high state and relay RL2 in an on state (connecting to a right contact RL2-*b*). Further, when the CPU 203 places the RL4 on signal in a high state and operates the RL4 latch part 204*c* to place the relay RL4 in an on state, the fixing apparatus 100 is in a power-suppliable state. Since the fixing apparatus 100 is in a power-suppliable state and the current path H1 is connected in parallel to the current path H2, the heater 300 enters a state with a low resistance value.

Now, the voltage detection part 207 will be described. The voltage detection part 207, which is a first detection part, determines whether the voltage applied to the current path H2 is from a 100 V system or a 200 V system. Further, if a determination is made that the current path H2 is connected to the 200 V system, and when a failure state described later in FIG. 3D is detected, the voltage detection part 207 places the RL off 1 signal in a low state to be output to the relay control part 204. When the RL off 1 signal in a low state is input, the relay control part 204 operates the RL1, RL3, and RL4 latch parts 204*a* to 204*c* to maintain the relays RL1, RL3, and RL4 in an off state to stop supplying power to the fixing apparatus 100. The operation of the voltage detection part 208 is the same as that of the voltage detection part 207, and thus the description thereof is omitted. Note that the voltage detection part 208 outputs, to the relay control part 204, the RL off 2 signal, which is a detection result of a voltage applied to the current path H2. The electrical circuits of the voltage detection part 207 and the voltage detection part 208 will be described by referring to FIG. 2B. Here, a positive half wave is defined as a state in which the voltage of the AC1 of the commercial AC power supply 201 is higher than that of the AC2; and a negative half wave is defined as a state in which the voltage of the AC1 is lower than that of the AC2. What is meant by the voltage detection part 207 detecting a positive half wave voltage is that the voltage of the AC3 is higher than that of the AC4. In contrast to this, the voltage detection part 208, which is a second detection part, detects a negative half wave voltage, meaning that the voltage of the AC5 is higher than that of the AC6.

FIG. 2B is a circuit diagram of the voltage detection part 202, the voltage detection part 207 and the voltage detection part 208. FIGS. 2A and 2B illustrate an example of a voltage detection part for use in the voltage detection part 202. The circuit operation for determining whether the range of a voltage applied to AC1 to AC2 is from the 100 V system or the 200 V system will be described. If the voltage applied to the AC1 to AC2 is from the 200 V system, the voltage applied to AC1 to AC2 is higher than a zener voltage (threshold voltage for conducting current through a zener diode) of a zener diode 231, and a current flows to the AC1 to AC2. A diode 232 is a current-backflow prevention diode, a resistor 234 is a current-limiting resistor, and a resistor 235 is a protection resistor for a photo coupler 233. When a current flows into a primary light-emitting diode of the photo coupler 233, a secondary transistor operates. Then, a current flows from Vcc through a resistor 236. Then, a gate voltage of an FET 237 is in a low state and the FET 237 enters an off state. When the FET 237 enters an off state, a charging current flows into a capacitor 240 from Vcc through a resistor 238. A diode 239 is a current-backflow prevention diode and a resistor 241 is a discharging resistor.

The higher the ratio of the time (on duty) during which voltage applied to the AC1 to AC2 is higher than the zener voltage of the zener diode 231, the higher the ratio of an off time of the FET 237 in a cycle of an alternating waveform of the commercial AC power supply 201. The higher the ratio of the off time of the FET 237, the longer the time during which a charging current flows from Vcc through the resistor 238. Thus, the voltage of the capacitor 240 increases. When the voltage of the capacitor 240 exceeds a comparison voltage of a comparator 242 determined by voltage dividing resistors: a resistor 243 and a resistor 244, a current flows from Vcc to an output part of the comparator 242 through a resistor 245. Then, the voltage of the output part of the comparator 242 is in a low state, that is, the VOLT signal is in a low state. The circuit configuration of the voltage detection part 207 and the voltage detection part 208 is the same as that of the voltage detection part 202, and thus the description thereof is omitted (corresponding portions are parenthesized in the figure). Note that when the voltage detection part 207 detects the 200 V system, the RL off 1 signal is in a low state; and when the voltage detection part 208 detects the 200 V system, the RL off 2 signal is in a low state. The present embodiment focuses on a method of using the circuit illustrated in FIG. 2B, but an arithmetic apparatus such as a microcomputer may be used to calculate the ratio of the time during which the voltage applied to the AC1 to AC2 is higher than the zener voltage of the zener diode 231.

Detection of Failure State

Figure 3A:
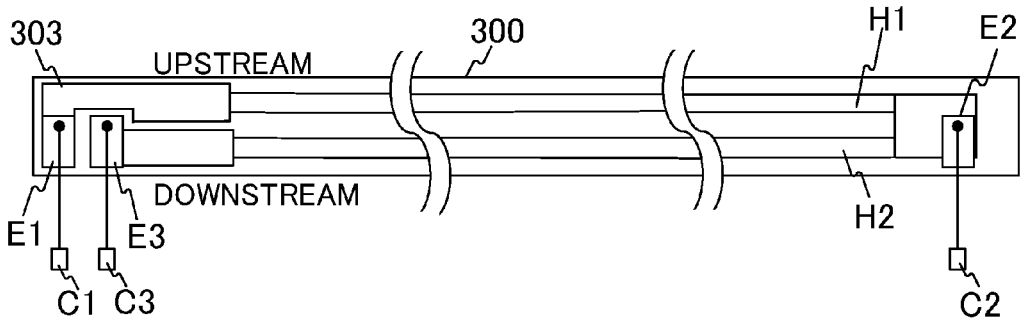
FIG. 3A illustrates a heating pattern, a conductive pattern and an electrode formed on a substrate of a heater according to the first embodiment.
Figure 3B:
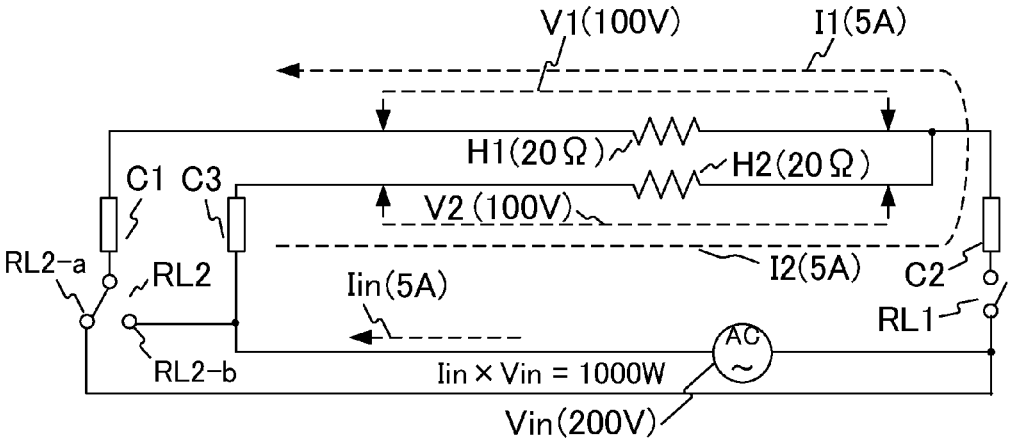
FIG. 3B illustrates a current path of the heater in a first operating state of the heater according to the first embodiment.
Figure 3C:
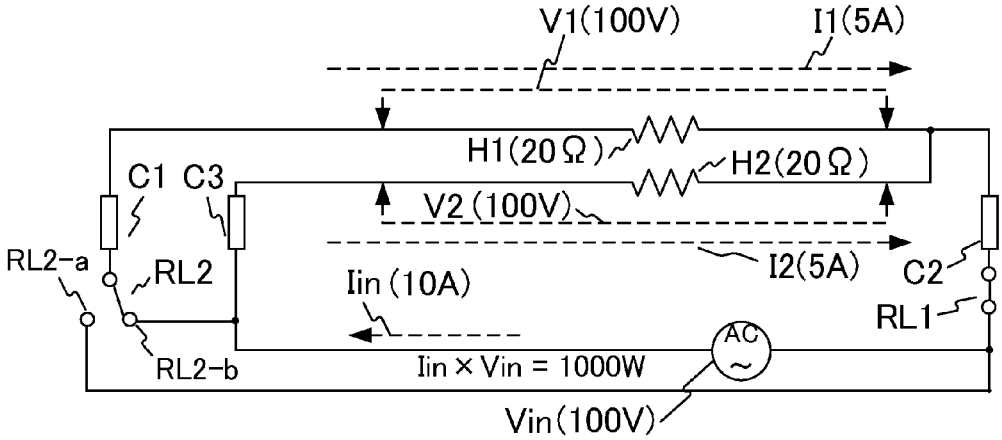
FIG. 3C illustrates a current path of the heater in a second operating state of the heater according to the first embodiment.
Figure 3D:
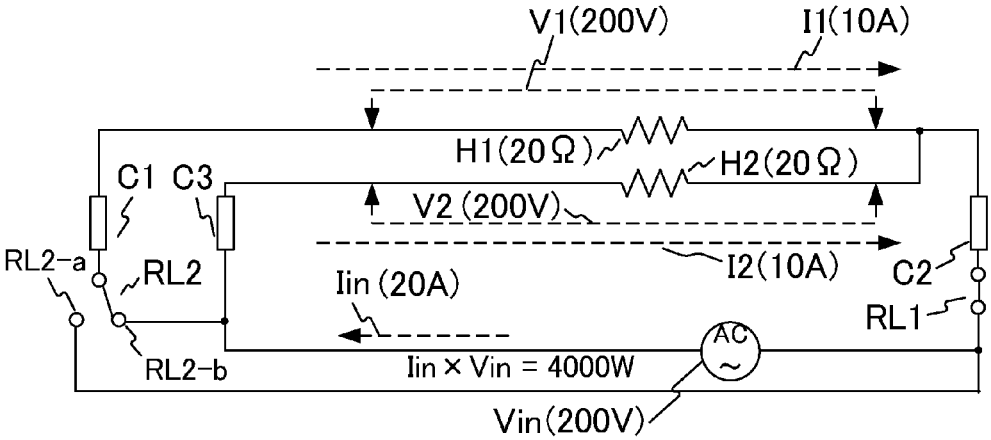
FIG. 3D illustrates a current path in a failure state of the heater according to the first embodiment.

FIGS. 3A to 3C are schematic drawings for illustrating the heater 300 and a current path of the heater 300 for use in the present embodiment. FIG. 3A illustrates a heating pattern, a conductive pattern and an electrode formed on a heater substrate 105. For convenience for describing the connection to the control circuit 200 of FIGS. 2A and 2B, connection parts C1, C2 and C3 to the connectors of FIGS. 2A and 2B are also illustrated. The heater 300 includes current paths H1 and H2 made of a resistance heating pattern. The heater 300 further includes a conductive pattern 303. Power is supplied to the current path H1 of the heater 300 through an electrode E1 and an electrode E2, and power is supplied to the current path H2 through an electrode E2 and an electrode E3. The electrode E1 is connected to the connector C1, the electrode E2 is connected to the connector C2, and the electrode E3 is connected to the connector C3. FIG. 3B is a drawing for illustrating a current path of the heater 300 in a state (hereinafter referred to as a first operating state) in which in the case of a supply voltage (Vin) of 200 V, the current path H1 is serially connected to the current path H2. For convenience of description, each resistance value of the current path H1 and the current path H2 is, for example, 20Ω. In the first operating state, 20Ω resistors are serially connected and thus the combined resistance value of the heater 300 is 40Ω. Since the supply voltage is 200 V, the current (Iin) supplied to the heater 300 is 5 A, and the power (Iin×Vin) is 1000 W. A current I1 of the current path H1 and a current I2 of the current path H2 each are 5 A. A voltage V1 of the current path H1 and a voltage V2 of the current path H2 each are 100 V.

FIG. 3C is a drawing for illustrating a current path of the heater 300 in a state (hereinafter referred to as a second operating state) in which in the case of a supply voltage (Vin) of 100 V, the current path H1 is parallelly connected to the current path H2. In the second operating state, 20Ω resistors are connected in parallel and thus the combined resistance value of the heater 300 is 10Ω. Since the supply voltage is 100 V, the current (Iin) supplied to the heater 300 is 10 A, and the power (Iin×Vin) is 1000 W. The current I1 of the current path H1 and the current I2 of the current path H2 each are 5 A. The voltage V1 supplied to the current path H1 and the voltage V2 supplied to the current path H2 each are 100 V.

A comparison is made among the voltage, the current and the power supplied to the heater 300 in the state illustrated in FIGS. 3B and 3C. For example, when the voltage V1 or V2 is detected, in the state of FIG. 3B, the voltage value is 100 V and the power supplied to the heater 300 is 1000 W; while in the state of FIG. 3C, the voltage value is 100 V and the power supplied to the heater 300 is 1000 W. When the current I1 or I2 is detected, in the state of FIG. 3B, the current value is 5 A and the power supplied to the heater 300 is 1000 W; while in the state of FIG. 3C, the current value is 5 A and the power supplied to the heater 300 is 1000 W. When the current I1, the current I2, the voltage V1 and the voltage V2 are detected in this manner, even though the operating state of the heater 300 is switched from the first operating state to the second operating state, the current value and the voltage value proportional to the power supplied to the heater 300 can be detected.

FIG. 3D is a schematic view for illustrating a current path in a failure state of the heater 300 for use in the present embodiment. FIG. 3D is a drawing for illustrating the current path of the heater 300 when the supply voltage (Vin) is 200 V and the heater 300 enters a second operating state with a low heater resistance value. More specifically, since the supply voltage is 200 V, when in a normal state, as illustrated in FIG. 3B, the relay RL1 and the relay RL2 should be in an off state, but the relays RL1 and RL2 are in an on state, and thus the current paths H1 and H2 are connected in parallel to each other. In the second operating state, a combined resistance value of the heater 300 is 10Ω. Since the supply voltage is 200 V, the current (Iin) supplied to the heater 300 is 20 A and the power supplied to the heater 300 is 4000 W. Thus, the heater 300 enters an overpower state. In the failure state, a larger power is supplied to the heater 300 than in a normal state (FIG. 3B). Therefore, the failure state, namely, the overpower state needs to be detected. As described in FIGS. 3B and 3C, the currents I1 and I2 in the normal state are 5 A in both the first operating state and the second operating state; and the voltages V1 and V2 are 100 V in both the first operating state and the second operating state. In contrast to this, in a state of FIG. 3D, which is a failure state, the current path H1 has a current I1 of 10 A and a voltage V1 of 200 V; and the current path H2 has a current I2 of 10 A and a voltage V2 of 200 V. In such a failure state, the current I1, the current I2, the voltage V1 and the voltage V2 of the current path H1 or the current path H2 is double that of the normal state. Thus, the failure state indicating an overpower state can be detected by detecting the current I1, the current I2, the voltage V1 or the voltage V2.

Note that when the failure state of FIG. 3D changes to a failure state in which the relay RL2 enters an off state (connecting to the contact RL2-*a*), no current or voltage is applied to the current path H1, and a current and a voltage are applied to only the current path H2. In this case, the current I1 is OA, the voltage V1 is 0 V, the current I2 is 10 A, and the voltage V2 is 200 V. Therefore, the failure state can be detected by checking only the current path H2 for a current or a voltage. In light of this, the voltage detection parts 207 and 208 of the present embodiment check the current path H2 for a voltage. For the same reason, the current detection parts 205 and 209 according to third and fourth embodiments check the current path H2 for a current.

Failure State Detection of Triac

Figure 4A:
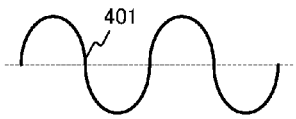
FIG. 4A is an explanatory drawing when a failure state (state in which a second operating state occurs even though the supply voltage is 200 V system and power supply to a heater 300 is in an overpower state) of FIG. 3D occurs and further a triac TR1 fails.
Figure 4A:
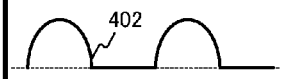
Figure 4A:
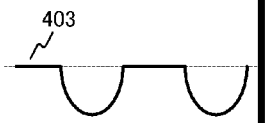

FIG. 4A is an explanatory drawing when a failure state (state in which the second operating state occurs even though the supply voltage is from the 200 V system and the power supply to the heater 300 is in an overpower state) of FIG. 3D occurs and further a triac TR1 fails. The illustration focuses on detection results of the voltage detection part 207 and the voltage detection part 208 in each failure state (a full wave short failure, a positive side of half wave short failure and a negative side of half wave short failure) of the triac TR1. FIG. 4A illustrates a relation among a voltage waveform of a voltage applied to between AC3 and AC4 (AC5 and AC6) in the failure state of FIG. 3D and in each failure state of the triac TR1; a current effective value of the current path H2; a voltage effective value of the current path H2; and a power supplied to the heater 300. The voltage waveform in each failure state of the triac TR1 includes a voltage waveform 401 in a full wave short failure state of the triac TR1; a voltage waveform 402 in a positive side of half wave short failure state of the triac TR1; and a voltage waveform 403 in a negative side of half wave short failure state of the triac TR1. As illustrated in FIG. 3D, when the triac TR1 causes a full wave short failure, the voltages V1 and V2 are 200 V; and the currents I1 and I2 are 10 A. The power supplied to the heater 300 is 4000 W, which means that the apparatus has entered an overpower state. When the triac TR1 causes a positive side of half wave short failure, the voltage effective value of the voltages V1 and V2 is 141 V; the current effective value of the currents I1 and I2 is 7 A; and the power supplied to the heater 300 is about 2000 W, which means that the apparatus has entered an overpower state. When the triac TR1 causes a negative side of half wave short failure, the voltage effective value of the voltages V1 and V2 is 141 V; the current effective value of the currents I1 and I2 is about 7 A; and the power supplied to the heater 300 is about 2000 W, which means that the apparatus has entered an overpower state.

Meanwhile, if a fixing apparatus (non-universal type of heating apparatus) without a function of switching a resistance value is used, for example, assuming that the supply voltage is 200 V and the resistance value of the current path is 40Ω, the power supplied to the fixing apparatus is 1000 W. In this case, when the triac causes a half wave short failure, the power supplied to the fixing apparatus is about 500 W. In the fixing apparatus (non-universal type of heating apparatus) without a function of switching the resistance value, the power supplied at a half wave short failure is reduced. Therefore, the fixing apparatus can be protected by a safety circuit using the safety element 112 and the temperature detection element 111. However, according to the heater 300 of the present embodiment, when the triac TR1 causes a half wave short failure, 2000 W of power is supplied to the heater 300, which is then placed in an overpower state in an example illustrated in FIGS. 4A and 4B. Since the power supplied to the heater 300 is large, the safety circuit using the safety element 112 and the temperature detection element 111 may not protect the fixing apparatus 100 due to impaired responsiveness. According to the fixing apparatus having a function of switching between the serial and parallel connections described in the present embodiment, even if the triac TR1 causes a half wave short failure, a large amount of power may be supplied to the heater 300. Therefore, an overpower state needs to be detected even in a half wave short failure state of the triac TR1 in a failure state of FIG. 3D.

Figure 4B:
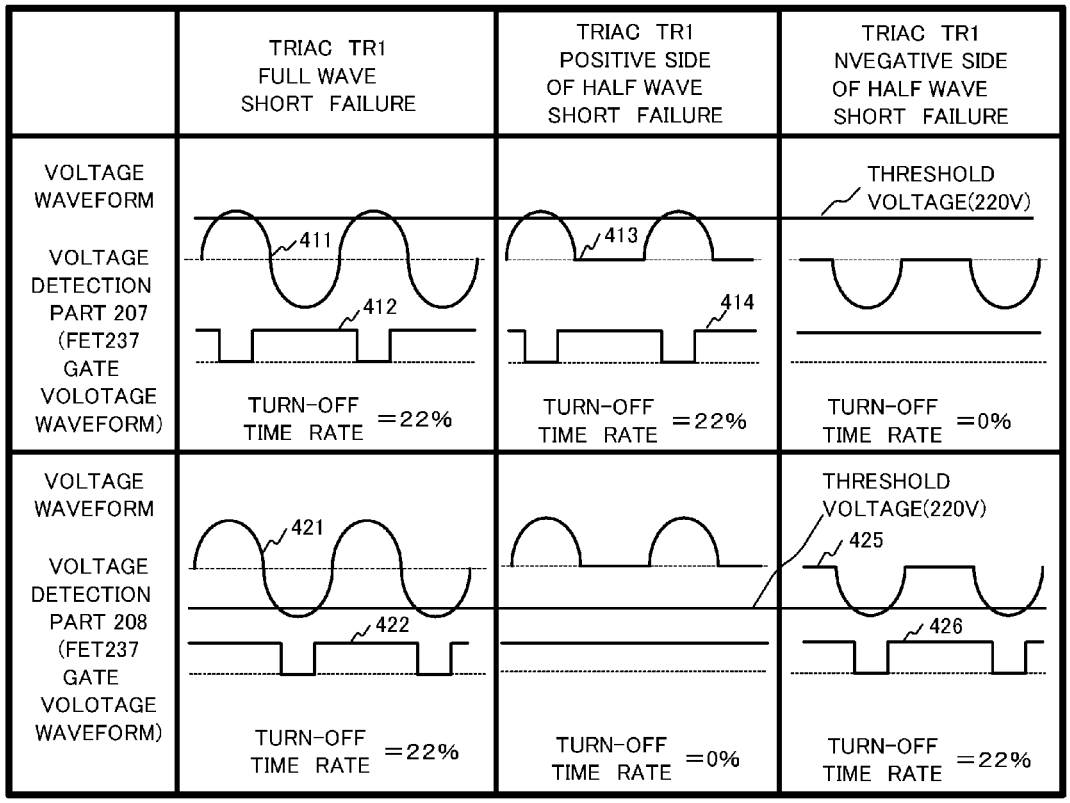
FIG. 4B illustrates operations of a voltage detection part 207 and a voltage detection part 208.

FIG. 4B illustrates a voltage waveform of a voltage applied to between AC3 and AC4 (AC5 and AC6) and a gate voltage waveform of the FET 237 for the purpose of illustrating the operation of the voltage detection part 207 and the voltage detection part 208. In the voltage detection part 207 and the voltage detection part 208, when the voltage applied to between AC3 and AC4 (AC5 and AC6) exceeds a zener voltage (e.g., 220 V) of the zener diode 231, the gate voltage of the FET 237 is in a low state and the FET 237 enters an off state. When the FET 237 enters an off state, a charging current flows from Vcc to the capacitor 240 through the resistor 238. When the ratio of the off time of the FET 237 increases and the voltage of the capacitor 240 exceeds the comparison potential of the comparator 242, the voltage of the RL off 1 (RL off 2) signal is in a low state. More specifically, when the voltage V2 applied to the current path H2 detected by the voltage detection part 207 is in a high state, an overpower state of the heater 300 can be detected as illustrated in FIG. 3D.

FIG. 4B illustrates a voltage waveform 411 input by the voltage detection part 207 and a gate voltage waveform 412 of the FET 237 of the voltage detection part 207 in the full wave short failure state. As illustrated in the voltage waveform 411, in a period during which the voltage exceeds a zener voltage of 220 V of the zener diode 231, the gate voltage of the FET 237 is in a low state and the FET 237 enters an off state. Here, the ratio of an off period (off time) to an on period (on time) (the time during which the voltage is equal to or less than the zener voltage and the FET 237 enters an on state) is about 22%. Assuming that the voltage of the RL off 1 signal is set to be in a low state when the ratio of the off period exceeds about 15% (predetermined ratio), the voltage of the RL off 1 signal is in a low state, and an overpower state can be detected. FIG. 4B further illustrates a voltage waveform 421 input to the voltage detection part 208 and a gate voltage waveform 422 of the FET 237 of the voltage detection part 208 in the full wave short failure state. The voltage detection part 208 checks the voltage waveform of an input voltage for a negative half wave voltage. As illustrated in the voltage waveform 421, in the period during which the voltage exceeds a zener voltage of 220 V of the zener diode 231, the gate voltage of the FET 237 is in an on state. Like the voltage detection part 207, the ratio of the off time is about 22%, and the voltage of the RL off 2 signal is in a low state. Therefore, the overpower state can be detected. FIG. 4B further illustrates a voltage waveform 413 input to the voltage detection part 207 and a gate voltage waveform 414 of the FET 237 of the voltage detection part 207 in a positive side of half wave short failure state. The ratio of the off time is about 22%, and the RL off 1 signal is in a low state. Therefore, the overpower state can be detected. Note that in a positive side of half wave short failure state of the triac TR1, the ratio of the off time of the voltage detection part 208 is 0%. FIG. 4B further illustrates a voltage waveform 425 input to the voltage detection part 208 and a gate voltage waveform 426 of the FET 237 of the voltage detection part 208 in the negative side of half wave short failure state. The ratio of the off time is about 22%, and the RL off 2 signal is in a low state. Therefore, the overpower state can be detected. Note that in a negative side of half wave short failure state of the triac TR1, the ratio of the off time of the voltage detection part 207 is 0%.

As described above, the present embodiment has a configuration of combining the voltage detection part 207 detecting a positive phase half wave and the voltage detection part 208 detecting a negative phase half wave. Even if the triac TR1 is in a positive or negative side of half wave short failure state, the ratio of the off time of the FET 237 is the same as in a full wave short failure state. Thus, the failure state of FIG. 3D in a half wave failure state of the triac TR1 can be accurately detected.

As illustrated in FIG. 4A, when detection of a full wave short failure is compared with detection of a half wave short failure, the voltage effective value is reduced from 200 V to 141 V and the current effective value is reduced from 10 A to 7 A. When detection of a full wave using the voltage detection part described in FIG. 2B is compared with detection of a half wave, assuming that the zener voltage is set to 220 V, the ratio of the off time of the FET 237 is reduced from about 44% to about 22%. For example, if a setting is made to detect an overpower state when the ratio of the off time exceeds about 30%, the failure state illustrated in FIG. 3D may not be detected. Thus, when a full wave detection is made, the failure state illustrated in FIG. 3D may not be detected.

Failure Detection Process

Figures 5, 5A, 5B:
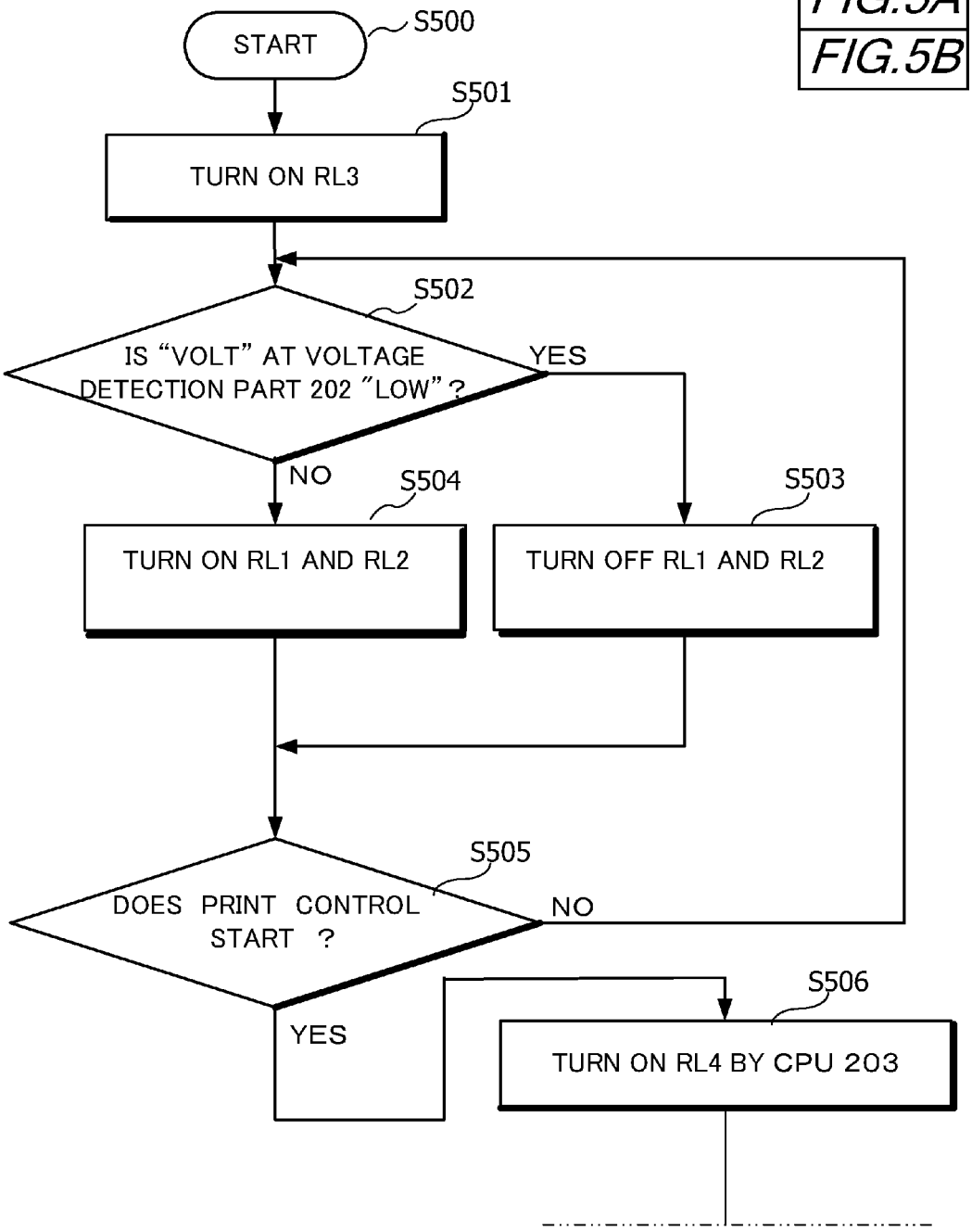
FIG. 5 is comprised of FIGS. 5A and 5B showing flowcharts describing a control process of the fixing apparatus according to the first embodiment.
Figure 5B:
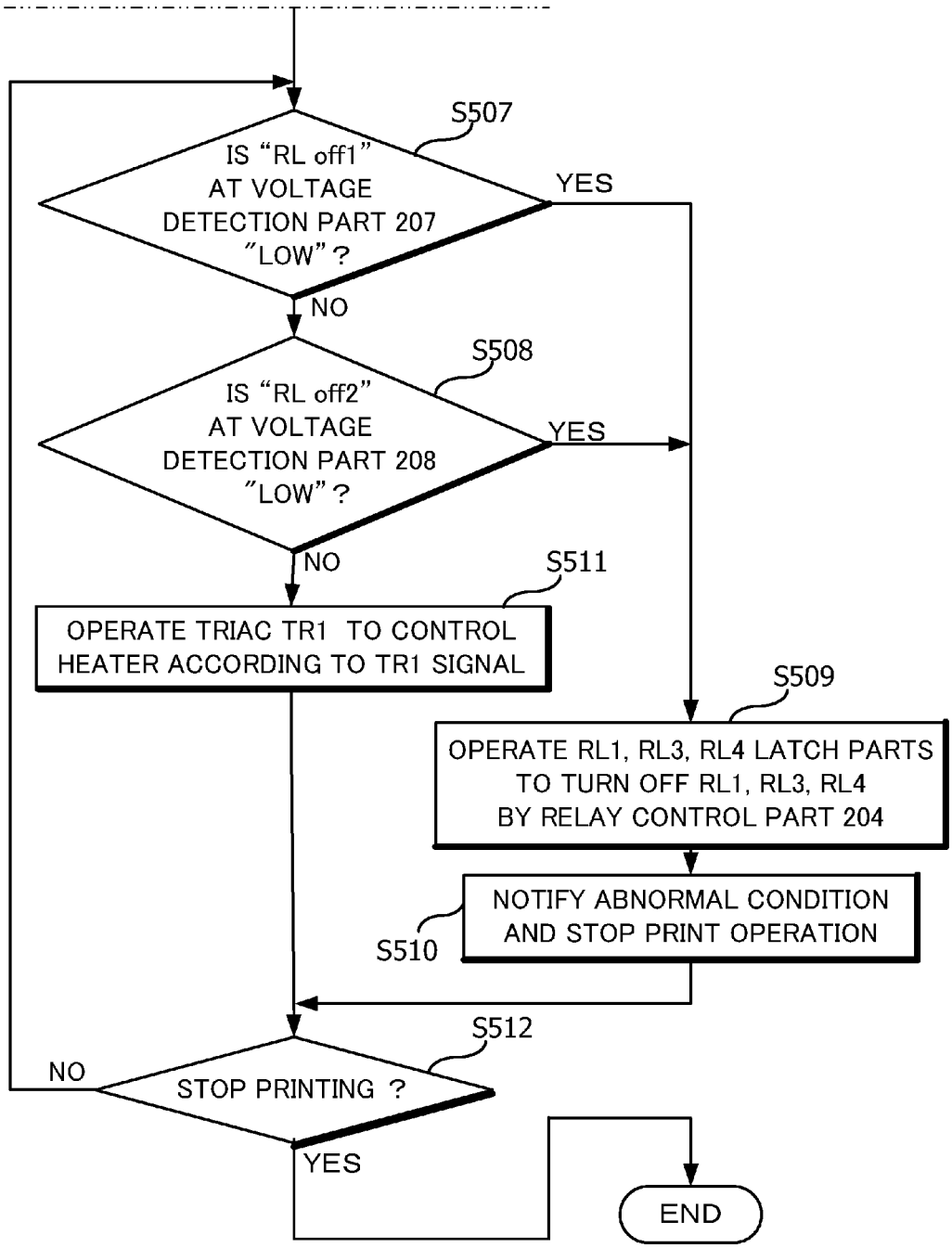

FIGS. 5A and 5B show flowcharts for describing a control sequence of the fixing apparatus 100 by the CPU 203 and the relay control part 204 according to the present embodiment. When the control circuit 200 enters a standby state, step (hereinafter referred to as "S") 501 and subsequent control start. In 5501, the relay control part 204 places the relay RL3 in an on state. In 5502, the CPU 203 determines a voltage range of the commercial AC power supply 201 based on the VOLT signal output from the voltage detection part 202, that is, determines whether the commercial AC power supply 201 is the 200 V system or the 100 V system. If in S502, the CPU 203 determines that the VOLT signal is in a high state, that is, the supply voltage is from the 100 V system, the process moves to S504; and if the CPU 203 determines that the VOLT signal is in a low state, that is, the supply voltage is from the 200 V system, the process moves to S503. In S503, the relay control part 204 maintains the relay RL1 and the relay RL2 in an off state and the process moves to S505. In S504, the relay control part 204 maintains the relay RL1 and the relay RL2 in an on state and the process moves to S505. In S505, the CPU 203 repeats the process in S502 to S504 until a determination is made that the print control starts. When a determination is made that the print control starts, the process moves to S506. In S506, the CPU 203 places the RL4 on signal in a high state and outputs the signal to the relay control part 204. The relay control part 204 places the relay RL4 in an on state.

If in S507, the CPU 203 determines that the RL off 1 signal output from the voltage detection part 207 is in a low state, that is, an overpower state is detected, the process moves to S509. If in S507, the CPU 203 determines that the RL off 1 signal output from the voltage detection part 207 is not in a low state, the process moves to S508. If in S508, the CPU 203 determines that the RL off 2 signal output from the voltage detection part 208 is in a low state, that is, an overpower state is detected, the process moves to S509. In S509, the relay control part 204 operates the RL1, RL3 and RL4 latch parts 204*a* to 204*c* to maintain the relays RL1, RL3 and RL4 in an off state (stop state), and the process moves to S510. In S510, the CPU 203 notifies the user of a failure state by displaying the failure state on an unillustrated operation display part or the like to perform an emergency stop of the print operation and stops the control. If in S508, the CPU 203 determines that the RL off 2 signal is not in a low state, that is, an overpower state is not detected, the process moves to S511. In S511, the CPU 203 controls the triac TR1 using PI control (PID control) based on the TH signal output from the temperature detection element 111. Thus, the CPU 203 performs a temperature control on the heater 300 by controlling power supplied to the heater 300 (phase control or wavenumber control). In S512, the processes in S507 to S511 will be repeated until the CPU 203 determines that printing ends. When the CPU 203 determines that printing ends, the control stops.

Thus, according to the present embodiment, a fixing apparatus capable of switching a resistance value allows detection of a failure state of the fixing apparatus in a simple configuration and can increase the safety of the fixing apparatus.

Hereinafter, the configuration and the operation of a second embodiment will be described.

Heater Control Circuit

Figure 6A:
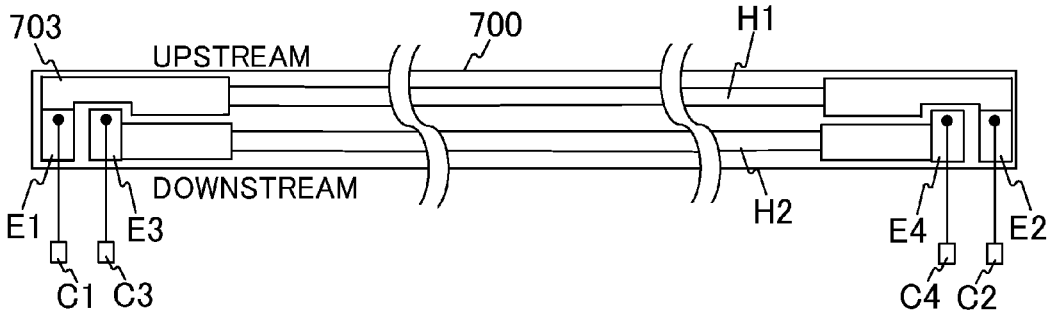
FIG. 6A illustrates a heating pattern, a conductive pattern and an electrode formed on a substrate of the heater according to a second embodiment.
Figure 6B:
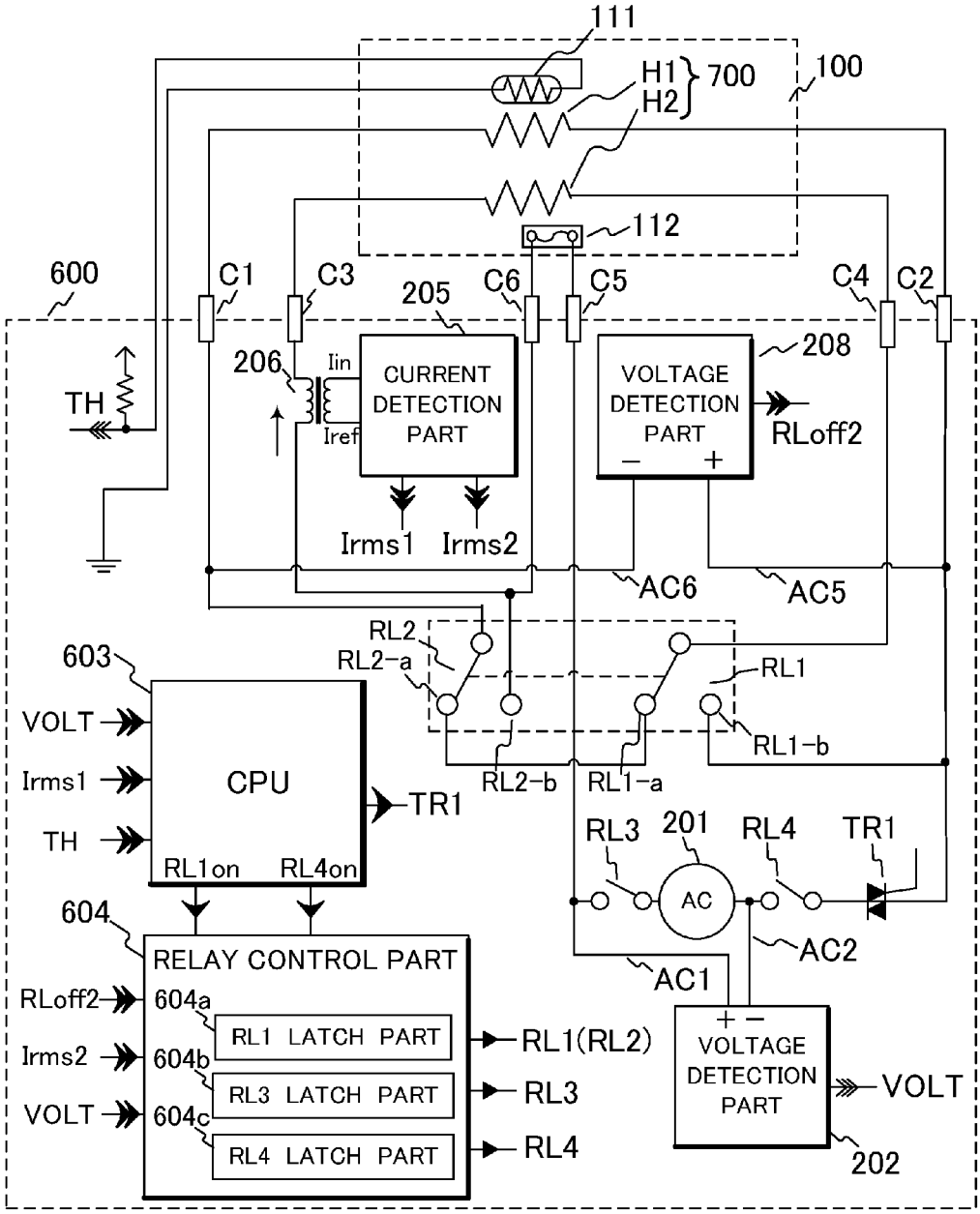
FIG. 6B illustrates a configuration of the fixing apparatus and the control circuit. The relays RL1, RL2, RL3 and RL4 in the figure illustrate a connection state of a contact in a power-off state.

Note that the description of the configuration similar to that of the first embodiment is omitted, and the description will be provided using the same reference numerals or characters. FIGS. 6A and 6B illustrate a heater 700 and a control circuit 600 respectively according to the second embodiment. FIG. 6A illustrates a heating pattern, a conductive pattern and an electrode formed on a substrate of the heater 700. The heater 700 includes current paths H1 and H2, each made of a resistance heating pattern. The heater 700 further includes a conductive pattern 703. Power is supplied to the current path H1 of the heater 700 through electrodes E1 and E2, and power is supplied to the current path H2 through electrodes E3 and E4. The electrode E1 is connected to the connector C1, the electrode E2 is connected to the connector C2, the electrode E3 is connected to the connector C3, and the electrode E4 is connected to the connector C4. FIG. 6B illustrates the control circuit 600 of the heater 700. FIG. 6B illustrates a connection state of a contact in a power-off state of relays RL1, RL2, RL3 and RL4. When the voltage detection part 202 detects that the commercial AC power supply 201 is a 200 V system, the relay control part 604 operates the RL1 latch part 604*a* to maintain the relay RL1 in an off state (connecting to a contact RL1-*a*). The present embodiment is characterized in that the relay RL2 operates in response to the relay RL1. Thus, the relay RL2 enters an off state at the same time as the relay RL1 (connecting to a contact RL2-*a*). Further, when the relay RL4 enters an on state, the fixing apparatus 100 is in a power-suppliable state. In this state, the current path H1 is serially connected to the current path H2, the heater 700 enters a state with a high resistance value. When the voltage detection part 202 detects that the commercial AC power supply 201 is the 100 V system, the relay RL1 enters an on state (connecting to a contact RL1-*b*). The relay RL2 operates in response to the relay RL1. Thus, the relay RL2 enters an on state at the same time as the relay RL1 (connecting to a contact RL2-*b*). Further, when the relay RL4 enters an on state, the fixing apparatus 100 is in a power-suppliable state. In this state, the current path H1 is connected in parallel to the current path H2, and the heater 700 enters a state with a low resistance value. The present invention can be applied to the fixing apparatus 100 capable of switching the connection state of the current path H1 and the current path H2 between serial and parallel connections using the relay RL1 and the relay RL2 which are two MBM contact relays.

Current Detection Part

The current detection part 205 detects a current effective value (or a square value of an effective value) of a positive half wave flowing toward a primary side (in a direction indicated by the arrow in FIG. 6B) through a current transformer 206. The current detection part 205 outputs an Irms 1 signal defined as an output of a value of a square of the current effective value for each cycle of the commercial power supply frequency and an Irms 2 signal defined as a mean value of variation of the Irms 1 signal. The current detection part 205 may have a configuration of detecting a peak current value or an average current value. The CPU 603 uses the Irms 1 signal to detect a current effective value for each cycle of commercial frequency. Based on the Irms 1 signal of the current detection part 205, the CPU 603 limits the current supplied to the heater 700. As an example of the method of limiting the current, the method described in Japanese Patent No. 3919670 may be used. As an example of the current detection part 205, the method proposed in Japanese Patent Application Laid-Open No. 2007-212503 may be used. The current detection part 205 outputs the Irms 2 signal to the relay control part 604. When an overcurrent flows in the current transformer 206, and the Irms 2 signal exceeds a predetermined threshold value (predetermined value), the relay control part 604 operates as follows. The relay control part 604 operates the RL1, RL3 and RL4 latch parts 604*a* to 604*c* to maintain the relays RL1 (together with the coordinating relay RL2), RL3 and RL4 in an off state, and stops supplying power to the fixing apparatus 100. Note that at this time, only the RL3 latch part 604*b* and the RL4 latch part 604*c* may be operated.

Here, the description will focus on a method of controlling current so as not to supply an overpower current to the heater 700. For example, when the current I1 and the current I2 are detected, setting the current limit to 5 A regardless of the operating state of the heater 700 allows the power supplied to the heater 700 to be limited to equal to or less than 1000 W. For example, in a normal state, based on the Irms 1 signal, control is performed so as to limit the I2 to be equal to or less than 5 A and a predetermined threshold current value of the Irms 2 signal is set to 6 A. In normal control, current is controlled to be equal to or less than 5 A. When power cannot be controlled due to a triac TR1 failure or the like, an abnormal current of 6 A or more is detected and the safety circuit can be operated by the Irms 2 signal. When the currents I1 and I2 are detected, the aforementioned power control unit can be implemented using the same settings (abnormal current and abnormal voltage) without using the operating state of the heater 700. In the heater 700 which is a resistance load, the voltages V1 and V2 are proportional to the currents I1 and I2. Thus, instead of current, voltage may be detected to perform a similar control.

The configuration and the operation of the voltage detection part 202 are the same as those of the first embodiment and thus the description thereof is omitted. According to the present embodiment, the current detection part 205 which is a first detection part detects a positive half wave current of the current path H2 and the voltage detection part 208 which is a second detection part detects a negative half wave voltage of the current path H1.

Figure 7:
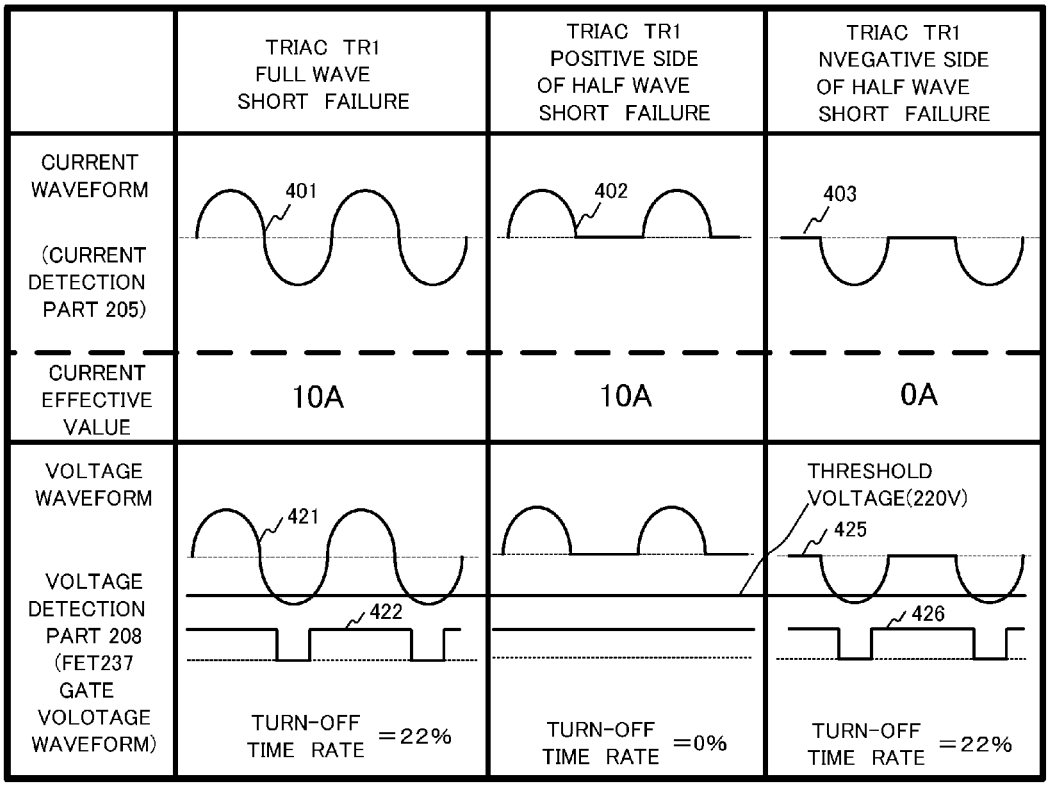
FIG. 7 illustrates a failure state of a triac TR1 and detection results in the state thereof by a current detection part 205 and a voltage detection part 208.

By referring to FIG. 7, failure states of the triac TR1 and detection results of the current detection part 205 and the voltage detection part 208 in the failure state of FIG. 3D will be described. The description of the voltage detection part 208 is the same as that of the first embodiment and thus is omitted. The current detection part 205 detects only the positive half wave (bold line in the figure). In a current waveform 711 indicating a full wave short failure state and in a current waveform 712 indicating a positive side of half wave short failure, a substantially equal 10 A can be detected. Thus, the present embodiment has a configuration of combining the current detection part 205 detecting a positive half wave and the voltage detection part 208 detecting a negative half wave. Thus, the failure state of FIG. 3D can be detected equally when the triac TR1 causes a full wave short failure, a positive side of half wave short failure, or a negative side of half wave short failure. Note that the combination of detections of a positive half wave and a negative half wave described in the first embodiment may further include a combination of detections of current and voltage. Note also that the control circuit 600 detects a failure state and then performs a similar process as described in the first embodiment. More specifically, in a step corresponding to S507 of FIGS. 5A and 5B, if the Irms 2 signal output from the current detection part 205 exceeds a predetermined threshold value, a process corresponding to S509 is performed.

Thus, according to the present embodiment, a fixing apparatus capable of switching a resistance value allows detection of a failure state of the fixing apparatus in a simple configuration and can increase the safety of the fixing apparatus.

Hereinafter, the configuration and the operation of the third embodiment will be described.

Current Detection Part 209

Figure 8A:
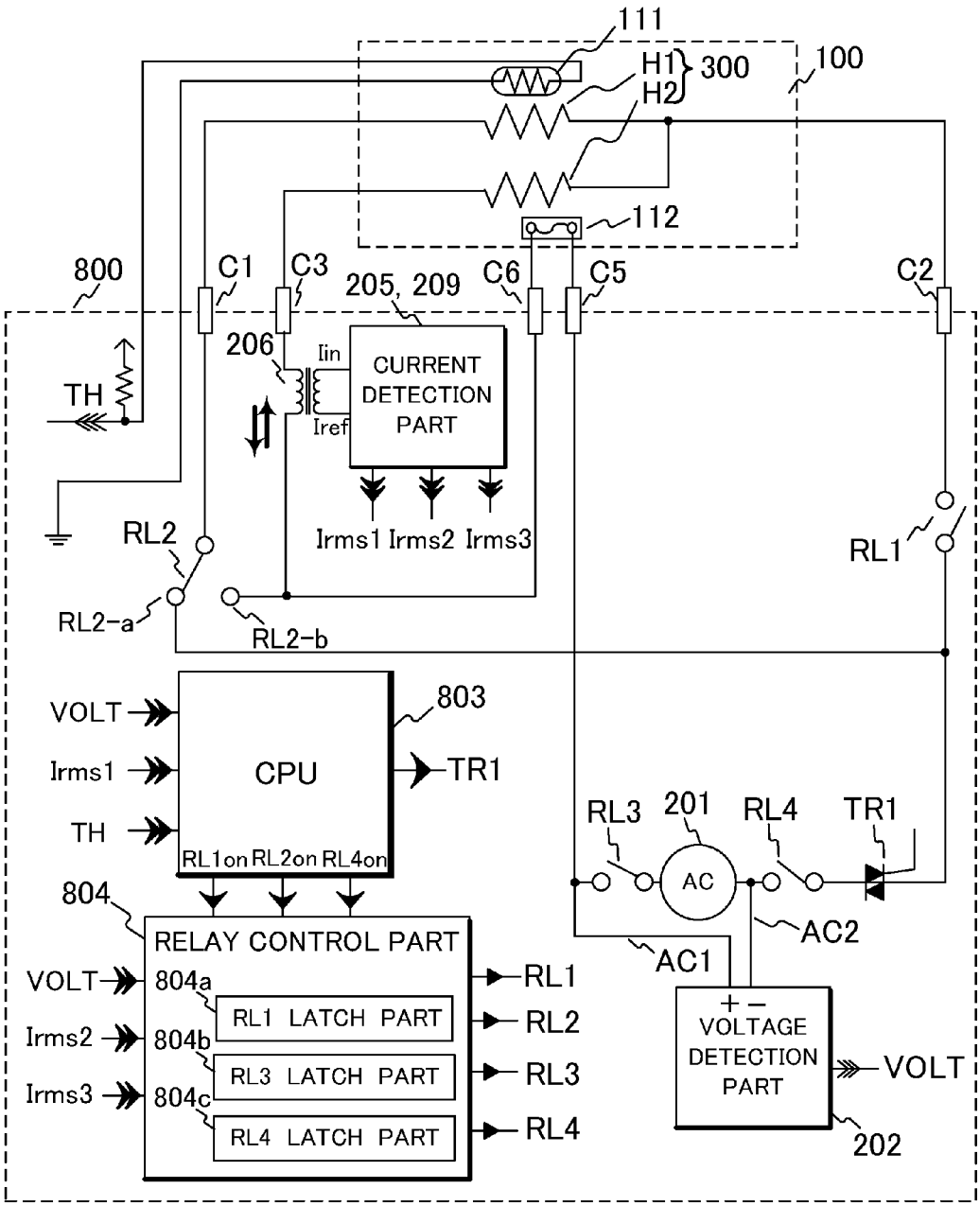
FIGS. 8A and 8B illustrate a configuration of a fixing apparatus and a control circuit according to a third embodiment.
Figure 8B:
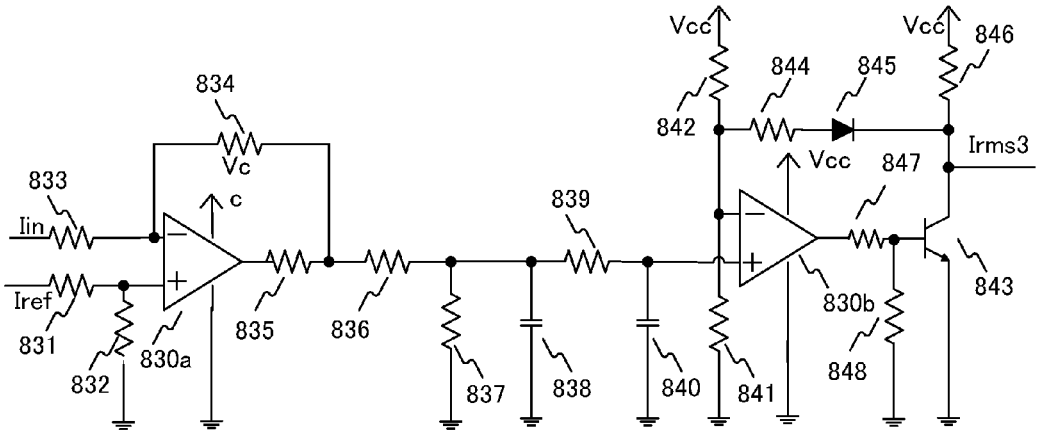

Note that the description of the configuration similar to that of the first embodiment is omitted, and a description will be provided using the same reference numerals or characters. FIGS. 8A and 8B illustrate a control circuit 800 of the heater 300 according to the third embodiment. The current detection part 205 is the same as that of the second embodiment and thus the description thereof is omitted. The outputs Iin and Iref of the current transformer 206 are output to the current detection part 205 and the current detection part 209. FIG. 8B is a circuit diagram for describing the current detection part 209 detecting a negative half wave. FIG. 8B illustrates an example of the current detection part. When the value of a negative current flowing in the current path H2 becomes large, the value of a voltage (output voltage) of the output Iin of the current transformer 206 becomes lower than the output Iref, which is a reference voltage. An operational amplifier 830*a* is used as a differential amplifier circuit. The amplification factor of the differential amplifier circuit can be determined by a ratio of the resistor 834/the resistor 833 and the resistors 832/831. A resistor 835 is a protection resistor for the operational amplifier 830*a*. The waveform inverted and amplified by the operational amplifier 830*a* is smoothed by a rear filter circuit. The inverted and amplified waveform is charged into a capacitor 838 through a resistor 836. A resistor 837 is a discharge resistor. The voltage waveform of the capacitor 838 is smoothed by a resistor 839 and a capacitor 840, and input to an operational amplifier 830*b*. When the voltage of the output Iin of the current transformer 206 is lower than the output Iref, the current charged into the capacitor 838 increases. When the voltage of the capacitor 840 exceeds the comparison voltage of an operational amplifier 830*b* determined by voltage dividing resistors: a resistor 841 and a resistor 842, an output of the operational amplifier 830*b* outputs Vcc. A transistor 843 enters an on state through a resistor 847 and a resistor 848, and a current flows from Vcc through a resistor 846. Then, an output Irms 3 signal is in a low state.

The current detection part 209 outputs the Irms 3 signal to the relay control part 804. The relay control part 804 can detect that a negative half wave current of the heater 300 is in an overpower state by detecting that the Irms 3 signal is in a low state. When the transistor 843 is in an on state, the comparison potential (hysteresis) of the operational amplifier 830*b* is reduced by the resistor 844. A diode 845 is a current-backflow prevention diode.

The filter circuit described in the present embodiment is an example of a smoothing circuit and the filter circuit may be designed according to a response speed required for the current detection part 209.

For example, when the resistance value of the discharge resistor 837 increases, the waveform inverted and amplified by the operational amplifier 830*a* is charged into the capacitor 838 through the resistor 836, and the peak value (peak current value) of the charged waveform is maintained. Then, a voltage corresponding to the peak value of the negative current flowing in the current path H2 can be detected. Conversely, when the resistance value of the discharge resistor 837 decreases and the capacitance of the capacitor 838 and the capacitor 840 increases, the time (time constant) required until a smoothing circuit of the current detection part 209 is stable is reduced as follows. More specifically, the waveform inverted and amplified by the operational amplifier 830*a* is charged into the capacitor 838 through the resistor 836 and a quasi-peak value of the charged waveform is maintained. Although the response speed required for the current detection part 209 is reduced, a circuit malfunction due to surge current and noise can be suppressed.

The present embodiment uses an output waveform of one current transformer 206 and a combination of the current detection part 205 detecting a current effective value of a positive half wave and the current detection part 209 detecting a negative half wave to detect an overpower state of the heater 300. The process following the detection of an overpower state of the heater 300 is the same as the process described in the first embodiment. After the failure state is detected, the control circuit 800 performs a similar process as described in the first embodiment. More specifically, in a step corresponding to S507 of FIGS. 5A and 5B, if the Irms 2 signal of the current detection part 205 exceeds a predetermined threshold value, a process corresponding to S509 is performed. If in a step corresponding to S507, the Irms 2 signal of the current detection part 205 is equal to or less than the predetermined threshold value, the process moves to a step corresponding to S508. If in a step corresponding to S508, the Irms 3 signal of the current detection part 209 is in a low state, a process corresponding to S509 is performed.

Thus, according to the present embodiment, a fixing apparatus capable of switching a resistance value allows detection of a failure state of the fixing apparatus in a simple configuration and can increase the safety of the fixing apparatus.

Hereinafter, the configuration and the operation of the fourth embodiment will be described.

Current Detection Part 210

Figure 9:
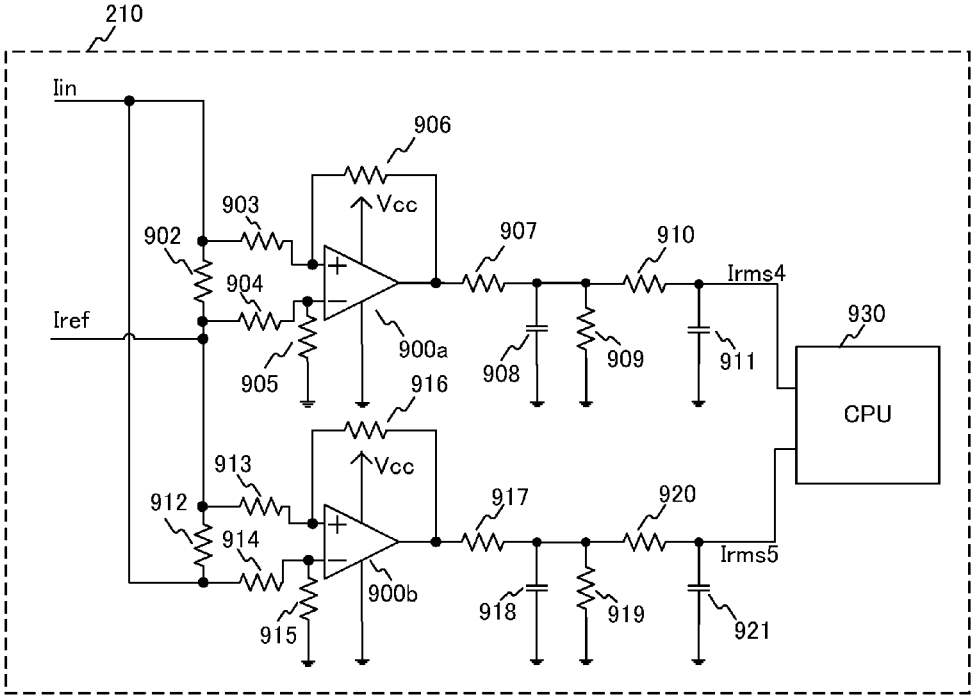
FIG. 9 illustrates a configuration of a current detection part according to a fourth embodiment.

Note that the description of the configuration similar to that of the third embodiment is omitted, and a description will be provided using the same reference numerals or characters. The fourth embodiment focuses on a method of using a current detection part 210 instead of the current detection part 209 detecting a negative half wave. FIG. 9 is a circuit diagram illustrating a configuration of the current detection part 210. When a negative current of an alternating current flows into the current path H2, the voltage value of the output Iin is lower than that of the output Iref, and a negative voltage is applied to a resistor 902. An operational amplifier 900*a* is used as a differential amplifier circuit. The operational amplifier 900*a* uses resistors 903 to 906 to set an amplification factor to invert, amplify and output a voltage applied to the resistor 902 by a predetermined amplification factor. The output of the differential amplifier circuit is charged into a capacitor 908 through a charge resistor 907. A resistor 909 is a discharging resistor. Further, the voltage waveform smoothed by a resistor 910 and a capacitor 911 is input to a CPU 930 as an Irms 4 signal (second detection result) detecting a negative half wave current.

When a positive current flows into the current path H2, the voltage value of the output Iin is higher than that of the output Iref, and a negative voltage is applied to a resistor 912. An operational amplifier 900*b* is used as a differential amplifier circuit. The operational amplifier 900*b* uses resistors 913 to 916 to set an amplification factor to invert, amplify and output a voltage applied to the resistor 912 by a predetermined amplification factor. The output of the differential amplifier circuit is charged into a capacitor 918 through a charge resistor 917. A resistor 919 is a discharging resistor. Further, the voltage waveform smoothed by a resistor 920 and a capacitor 921 is input to a CPU 930 as an Irms 5 signal (first detection result) detecting a positive half wave current.

Thus, the current detection part 210 outputs the Irms 4 signal detecting a negative half wave current and the Irms 5 signal detecting a positive half wave current to the CPU 930. At normal control (at no failure), the heater 300 is controlled so as to allow a current having a positive phase and a current with a negative phase to be symmetrical. Therefore, the detection results are such that an output value of the Irms 4 signal is substantially the same as an output value of the Irms 5 signal. When the CPU 930 determines Irms 5>>Irms 4, the current detection part 210 of FIG. 9 can detect a positive side of half wave short failure. When the CPU 930 determines Irms 4>>Irms 5, the current detection part 210 can detect a negative side of half wave short failure state. That is, if the deviation between the Irms 4 signal and the Irms 5 signal is equal to or greater than a predetermined value, a positive side of half wave short failure state or a negative side of half wave short failure state can be detected.

The method of detecting a negative side of half wave short failure state will be described in comparison with the method of using only the Irms 4 signal. At normal control, the Irms 4 signal outputs a predetermined detection result. For example, in the failure state described in FIG. 3D, the detection result of the Irms 4 signal is larger than that during normal control. In order to detect the aforementioned failure state, a threshold value for detecting the failure state illustrated in FIG. 3D needs to be provided so as not to misdetect the failure state at normal control. According to the method of using a deviation between the Irms 4 signal and the Irms 5 signal, the deviation is approximately 0 at normal control, and thus a misdetection at normal control can be prevented. For example, in the failure state of FIG. 3D, a negative side of half wave short failure state can be accurately detected.

As described above, the current detection part 205 detects a positive current effective value and a square value of a current effective value. Power supplied to the heater 300 which is a resistance load is proportional to the square value of a current effective value. Therefore, the current detection part 205 can detect an overpower state of the heater 300 with a precision higher than that of the Irms 5 signal of the current detection part 210. For example, in the failure state of FIG. 3D, the current detection part 205 may be used to detect a positive half wave short state and a full wave short state; and the current detection part 210 may be used to detect a negative half wave short state. The circuit configuration of the current detection part 210 has a smaller circuit size than the current detection part 205 detecting a current effective value. Thus, the method described in the present embodiment can detect a positive side of half wave short failure state and a negative side of half wave short failure state in the failure state of FIG. 3D with a simpler configuration than the configuration of using two circuits detecting a current effective value.

Note that in a step corresponding to S507 of FIGS. 5A and 5B, when the Irms 2 signal of the current detection part 205 exceeds a predetermined threshold value, a process corresponding to S509 is performed. In the step corresponding to S507, when the Irms 2 signal of the current detection part 205 is equal to or less than the predetermined threshold value, the process moves to a step corresponding to S508. In the step corresponding to S508, when the Irms 4 signal and the Irms 5 signal of the current detection part 210 satisfy Irms 4>>Irms 5, a process corresponding to S509 is performed.

Thus, according to the present embodiment, a fixing apparatus capable of switching a resistance value allows detection of a failure state of the fixing apparatus in a simple configuration and can increase the safety of the fixing apparatus.

<An Example of an Image Forming Apparatus to which the Aforementioned Fixing Apparatus (Heating Apparatus) is Applied>

Hereinafter, the description will focus on a laser beam printer and an operation thereof as an example of an image forming apparatus having the fixing apparatus described in the above first to fourth embodiments.

Figure 10:
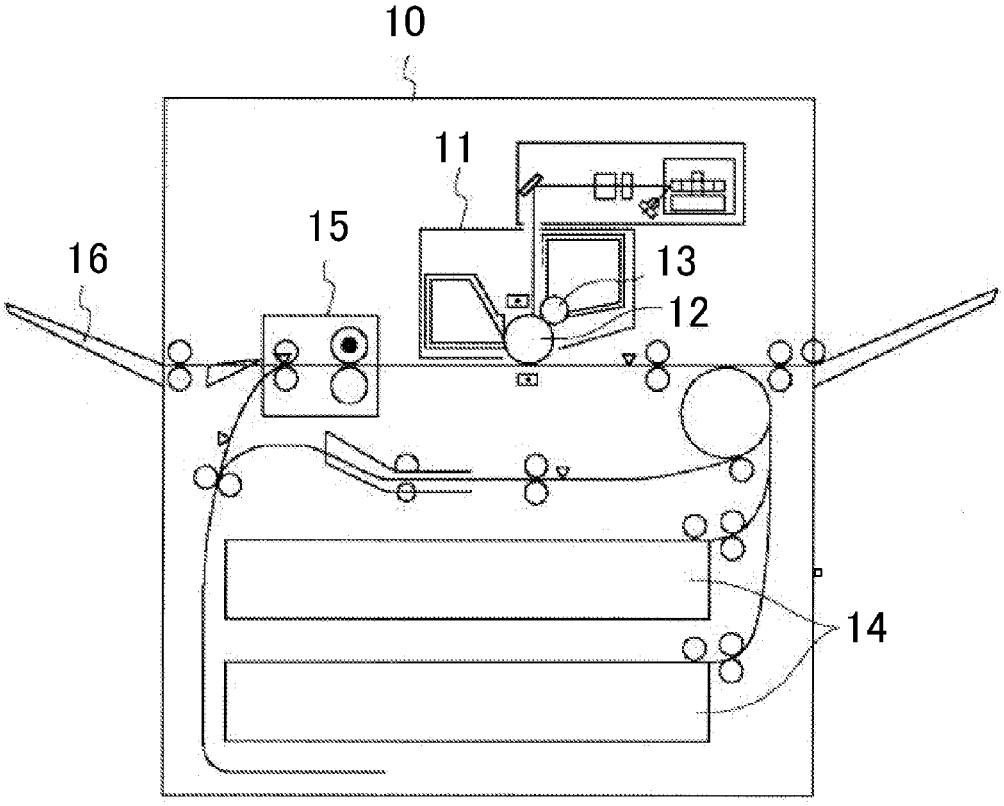
FIG. 10 illustrates a schematic configuration of an image forming apparatus to which the fixing apparatus of the present invention is applied.

FIG. 10 illustrates a schematic configuration view of the laser beam printer. In FIG. 10, a recording material is supplied from a cassette 14 which is a recording material storage part. An electrostatic latent image is formed on a photosensitive drum of an image forming part 11. A developing unit 13 uses toner to develop the formed electrostatic latent image to form an image on the photosensitive drum. Then, the image formed on the photosensitive drum is transferred to the recording material while the recording material is being conveyed. The image transferred to the recording material is heated and pressurized by the fixing apparatus 15 to fix the image on the recording material. Subsequently, the recording material to which the image is fixed is discharged to a paper discharge tray 16. Such a series of image forming operation is controlled by an unillustrated controller according to a preliminarily stored program. Note that the configuration of the first to fourth embodiments described above may be applied to the fixing apparatus 15 in the figure. Thus, the fixing apparatus of the laser beam printer is universally enabled and a safer fixing apparatus and image forming apparatus can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-110521, filed May 12, 2010, 2011-089377, filed Apr. 13, 2011, which are hereby incorporated by reference herein in their entirety.

What is claimed is:

1. A heating apparatus for supplying power to first and second heat generation members, wherein the heating apparatus is switchable between a first state in which the first and second heat generation members are connected in series and a second state in which the first and second heat generation members are connected in parallel, wherein the combined resistance of the first and second heat generation members in the second state is less than the combined resistance of the first and second heat generation members in the first state, the heating apparatus comprising:

a first detection part which detects a positive phase of a half wave in an alternating voltage of a commercial power supply applied to the second heat generation member in the second state;

a second detection part which detects a negative phase of a half wave in an alternating voltage of the commercial power supply applied to the second heat generation member in the second state, wherein the first detection part or the second detection part has a current transformer; and a control part which stops supplying power from the commercial power supply to the first and second heat generation members in a case where an overpower state is detected according to a detection result by the first detection part or a detection result by the second detection part, wherein the control part determines an overpower state in a case where a deviation between a first detection result in which power is detected by the current transformer of the first detection part and a second detection result in which power is detected by the current transformer of the second detection part is greater than a predetermined value.

2. The heating apparatus according to claim 1, wherein the first detection part or the second detection part has a zener diode, and detects the overpower state based on a ratio between a time period during which a voltage of the power supplied to the heat generation members is equal to or less than a threshold voltage of the zener diode and a time period during which a voltage of the power supplied to the heat generation members exceeds a threshold voltage of the zener diode in a cycle of an alternating voltage of the commercial power supply.

3. The heating apparatus according to claim 1, wherein the first detection part or the second detection part has a current transformer, and detects the overpower state in a case where a detection result of detecting one of a peak current value, an average current value, a current effective value or a square of a current effective value of a current flowing in the second heat generation member through the current transformer exceeds a predetermined value.

4. The heating apparatus according to claim 1, further comprising a switch part which switches the connection between the first and second heat generation members between a connection state and a disconnection state in a path for supplying power from the commercial power supply to the heat generation members, wherein when the control part detects the overpower state, the control part switches the switch to the disconnection state based on detection results of the first detection part or the second detection part.

5. The heating apparatus according to claim 1, further comprising a voltage detection part which detects an alternating voltage of the commercial power supply supplying power to the heat generation members, wherein based on a voltage detected by the voltage detection part, the connection between the first and second heat generation members is switched between the serial connection and the parallel connection, and thereby the resistance value of the heat generation member is switched.

6. An image forming apparatus comprising:

an image forming part configured to form an image on a recording material; and a heating part having first and second heat generation members that heat the recording material on which the image is formed and fixes the image on the recording material, the heating part supplying power to first and second heat generation members, wherein the heating part is switchable between a first state in which the first and second heat generation members are connected in series and a second state in which the first and second heat generation members are connected in parallel, wherein a combined resistance of the first and second heat generation members in the second state is less than the combined resistance of the first and second heat generation members in the first state;

a first detection part which detects a positive phase of a half wave in an alternating voltage of a commercial power supply applied to the second heat generation member in the second state;

a second detection part which detects a negative phase of a half wave in an alternating voltage the commercial power supply applied to the second heat generation member in the second state, wherein the first detection part or the second detection part has a current transformer; and a control part which stops supplying power from the commercial power supply to the first and second heat generation members in a case where an overpower state is detected according to a detection result by the first detection part or a detection result by the second detection part, wherein the control part determines an overpower state in a case where a deviation between a first detection result in which power is detected by the current transformer of the first detection part and a second detection result in which power is detected by the current transformer of the second detection part is greater than a predetermined value.

7. The image forming apparatus according to claim 6, wherein the first detection part or the second detection part has a zener diode, and detects the overpower state based on a ratio between a time period during which a voltage of the power supplied to the heat generation members is equal to or less than a threshold voltage of the zener diode and a time period during which a voltage of the power supplied to the heat generation members exceeds a threshold voltage of the zener diode in a cycle of an alternating voltage of the commercial power supply.

8. The image forming apparatus according to claim 6, wherein the first detection part or the second detection part has a current transformer, and detects the overpower state in a case where a detection result of detecting one of a peak current value, an average current value, a current effective value or a square of a current effective value of a current flowing in the second heat generation member through the current transformer exceeds a predetermined value.

9. The image forming apparatus according to claim 6, further comprising a switch part which switches the connection between the first and second heat generation members between a connection state and a disconnection state in a path for supplying power from the commercial power supply to the heat generation members, wherein when the control part detects the overpower state, the control part switches the switch to the disconnection state based on detection results of the first detection part or the second detection part.

10. The image forming apparatus according to claim 6, further comprising a voltage detection part which detects an alternating voltage of the commercial power supply supplying power to the heat generation members, wherein based on a voltage detected by the voltage detection part, the connection between the first and second heat generation members is switched between the serial connection and the parallel connection, and thereby the resistance value of the heat generation members is switched.

* * * * *